US006672481B2

(12) United States Patent
Ziesel

(10) Patent No.: US 6,672,481 B2
(45) Date of Patent: Jan. 6, 2004

(54) ON DEMAND CARBONATION SYSTEM

(75) Inventor: Lawrence B. Ziesel, Woodstock, GA (US)

(73) Assignee: The Coca-Cola Company, Atlanta, GA (US)

( * ) Notice: Subject to any disclaimer, the term of this patent is extended or adjusted under 35 U.S.C. 154(b) by 145 days.

(21) Appl. No.: 10/078,754

(22) Filed: Feb. 19, 2002

(65) Prior Publication Data

US 2002/0113087 A1 Aug. 22, 2002

Related U.S. Application Data

(60) Provisional application No. 60/270,730, filed on Feb. 22, 2001.

(51) Int. Cl.[7] ..... B67D 5/56

(52) U.S. Cl. ..... 222/129.1; 222/129.2; 222/608

(58) Field of Search ..... 222/129.1, 129.2, 222/146.6, 608, 253

(56) References Cited

U.S. PATENT DOCUMENTS 4,304,736 A 12/1981 McMillin et al.
4,436,493 A 3/1984 Credle, Jr. ..... 417/393
4,610,192 A 9/1986 Hartley et al. ..... 91/341 R
4,889,662 A 12/1989 Smith
4,927,567 A 5/1990 Rudick
4,967,936 A * 11/1990 Bingler ..... 222/129.2
5,000,352 A * 3/1991 Cleland ..... 222/129.2

OTHER PUBLICATIONS

Website Page entitled "SHURflo Heavy Duty Advantage BIB Gas Pump", pp. 1 & 2, printed on Apr. 1, 2002.
Website Page entitled "BIB Gas Pump Features and Operation", pp. 1 & 2, printed on Apr. 1, 2002.
Website Page entitled "Coca–Cola BIB Pump Systems", pp. 1–7, printed on Apr. 1, 2002.
Website Page entitled "Coca–Cola Beverage/Soda Pumps", one page only, printed on Apr. 1, 2002.

* cited by examiner

*Primary Examiner*—Philippe Derakshani
(74) *Attorney, Agent, or Firm*—Sutherland Asbill & Brennan LLP

(57) ABSTRACT

A beverage dispenser for providing a flow of carbonated water from a pressurized source of gas and a source of water. The dispenser may include a pump. The pump may be driven by the gas from the gas source to pump the water from the water source. The pump also may include a water outlet and a gas outlet. A connector may be in communication with the water outlet and the gas outlet so as to combine the gas and the water.

23 Claims, 2 Drawing Sheets

ON DEMAND CARBONATION SYSTEM

RELATED APPLICATIONS

The present application is a Non-provisional application based upon Provisional Application Ser. No. 60/270,730, filed on Feb. 22, 2001.

TECHNICAL FIELD

The present invention relates generally to a beverage dispenser and more particularly relates to a portable, gas driven beverage dispenser that creates carbonated water on demand.

BACKGROUND OF THE INVENTION

Beverage dispensers generally include a device for producing carbonated water. Once produced, the carbonated water may be stored within the dispenser so as to be available when needed. A common device for manufacturing and storing carbonated water is a carbonator tank. As is well known, most carbonator tanks include a plain water inlet, a carbon dioxide gas inlet, and a carbonated water outlet. Once the plain water and the carbon dioxide gas mix, the carbonated water remains in the carbonator tank until needed.

Most carbonator tanks also include a water level sensor that activates a water pump so as to keep the water within the carbonator tank at a predetermined level. The water level sensor is generally in communication with the water pump via an electronic circuit. As such, a source of electrical power generally is needed to operate the carbonator tank.

Although these known beverage dispensers and carbonator tanks adequately provide carbonated water and a carbonated beverage, there are several known drawbacks. For example, the known devices generally are not portable in that the supply of electric power is required. Further, the devices generally are large in size given the need for the carbonator tank and the associated elements.

What may be desired, therefore, is a beverage dispenser that is substantially portable. Such a beverage dispenser, however, should provide the same quality carbonated beverage as produced by the known devices while being reasonable in terms of costs, operation, and maintenance.

SUMMARY OF THE INVENTION

The present invention thus provides a beverage dispenser for providing a flow of carbonated water from a pressurized source of gas and a source of water. The dispenser may include a pump. The pump may be driven by the gas from the gas source to pump the water from the water source. The pump also may include a water outlet and a gas outlet. A connector may be in communication with the water outlet and the gas outlet so as to combine the gas and the water.

Specific embodiments of the invention may include the use of a T-joint as the connector. The pump may be a reciprocating pump. The pump may include a first chamber and a second chamber. A gas regulator may be positioned between the gas source and the pump so as to direct the gas to the first chamber and the second chamber. A first piston head may be positioned within the first chamber and a second piston head may be positioned within the second chamber. A linkage may connect the first piston head and the second piston head. The piston heads may each have a driving face and a pumping face.

The pump may include a gas inlet and a water inlet. The gas inlet may include a first chamber gas inlet positioned adjacent to the driving face of the first piston head and a second chamber gas inlet positioned adjacent to the driving face of the second piston head. The water inlet may include a first chamber water inlet positioned adjacent to the pumping face of the first piston head and a second chamber water inlet positioned adjacent to the pumping face of the second piston head. The gas outlet may include a first chamber gas outlet positioned adjacent to the driving face of the first piston head and a second chamber gas outlet positioned adjacent to the driving face of the second piston head. The water outlet may include a first chamber water outlet positioned adjacent to the pumping face of the first piston head and a second chamber water outlet positioned adjacent to the pumping face of the second piston head.

The supply valve may direct the gas from the gas supply to the first chamber gas inlet so as to force the first piston head away from the first chamber gas inlet and so as to force the second piston head towards the second gas inlet and open the second chamber water inlet. The supply valve may then direct the gas from the gas supply to the second chamber gas inlet so as to force the second piston head away from the second chamber gas inlet and to force the water within the second chamber out of the second chamber water outlet and so as to force the first piston head towards the first chamber gas inlet, force the gas within the first chamber out of the first chamber gas outlet, and open the first chamber water inlet. The supply valve may then direct the gas from the gas supply to the first chamber gas inlet so as to force the first piston head away from the first chamber gas inlet and to force the water within the first chamber out of the first chamber water outlet and so as to force the second piston head towards the second chamber gas inlet, force the gas within the second chamber out of the second chamber gas outlet, and open the second chamber water inlet.

The beverage dispenser may include a booster pump positioned downstream of the connector so as to boost the pressure of the carbonated water flow. The dispenser may include a cold plate positioned downstream of the booster pump so as to chill the carbonated water flow. The dispenser also may include a mixing valve positioned downstream of the cold plate so as to mix the carbonated water flow with a secondary fluid.

The present invention also may provide for a device for combining a gas and a liquid. The device may include a source of the gas, a source of the liquid, and a pump. The pump may be driven by the gas from the gas source to pump the liquid from the liquid source. The pump also may include a liquid outlet and a gas outlet. A connector may be in communication with the liquid outlet and the gas outlet so as to combine the gas and the liquid.

The present invention also may provide a portable beverage dispenser to serve a beverage from a source of a primary fluid, a source of a secondary fluid, and a source of a gas. The dispenser may include a cart, a primary fluid pump driven by the gas from the gas source to pump the primary fluid from the primary fluid source, a secondary fluid pump driven by the gas from the gas source to pump the secondary fluid from the secondary fluid source, and a mixing valve to mix the primary fluid and the secondary fluid. The primary fluid pump may include a gas outlet and a primary fluid outlet. A connector may be in communication with the gas outlet and the primary fluid outlet so as to combine the gas and the primary fluid.

These and other features of the present invention will become apparent after review of the following detailed description of the disclosed embodiments and the appended drawings and claims.

DETAILED DESCRIPTION OF THE DISCLOSED EMBODIMENTS

Figure 1:
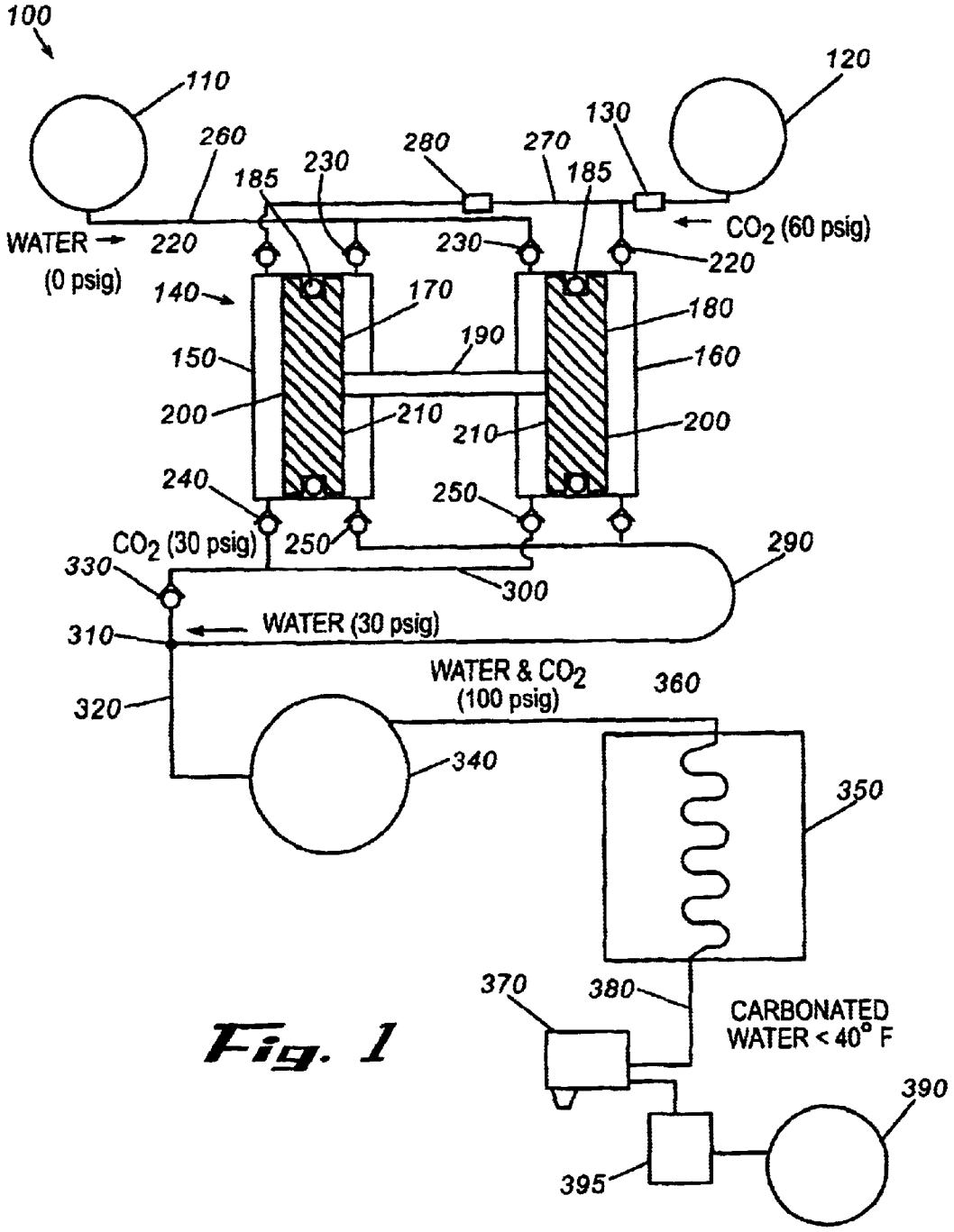
FIG. 1 is a schematic view of the components of the portable beverage dispenser of the present invention.

Referring now to the drawings, in which like numbers indicate like elements throughout the several views, FIG. 1 shows a beverage dispenser 100 of the present invention. The beverage dispenser 100 may include a plain water source 110 and a compressed gas source 120. The plain water source 110 may provide plain water at about atmospheric pressure or about zero (0) psig (pounds per square inch gauge) (about zero (0) kilograms per square centimeter) and at room temperature or lower. The plain water source 110 may be a source of conventional tap water or a water container of any convenient form and size. The gas source 120 generally provides a source of pressurized carbon dioxide gas. The gas source 120 may be any type of pressurized container. The gas source 120 may have a regulator 130 positioned adjacent thereto so as to regulate the pressure of the carbon dioxide gas flow. The regulator 130 may be of conventional design.

The beverage dispenser 100 also may have a water pump 140. The water pump 140 may be a conventional gas driven reciprocating pump or a similar type of device. For example, the water pump 140 may take the form of what is typically used in the beverage industry as a syrup or a concentrate pump. Such pumps are well known in the industry. For example, The Shurflo Pump Manufacturing Company, Inc. of Santa Ana, Calif., manufactures well-known gas-driven concentrate pumps. Other examples include U.S. Pat. No. 4,610,192 to Hartley et al., entitled "Reciprocable Device" and commonly owned U.S. Pat. No. 4,436,493 to Credle, Jr., entitled "Self Contained Pump and Reversing Mechanism Therefor". These references are incorporated herein by reference.

As is well known, the pump 140 may include two (2) chambers, a first chamber 150 and a second chamber 160. Positioned for movement within each chamber 150, 160 may be a piston head, a first piston head 170 in the first chamber 150 and a second piston head 180 in the second chamber 160. The piston heads 170, 180 may be in the form of diaphragms or similar types of devices. The piston heads 170, 180 may form a substantially airtight seal within the respective chambers 150, 160. Each piston head 170, 180 may have an O-ring 185 or a similar device positioned thereon to maintain such a seal. A rod 190 or a similar type of linkage may connect the piston heads 170, 180. The piston heads 170, 180 and the rod 190 provide reciprocating motion within the chambers 150, 160.

Each piston head 170, 180 may have a driving face 200 and a pumping face 210. Each chamber 150, 160 may have a gas inlet 220 and a water inlet 230. The gas inlet 220 may be on the side of the chamber 150, 160 adjacent to the driving face 200 of the piston head 170, 180. Likewise, the water inlet 230 may be adjacent to the pumping face 210 of the piston head 170, 180. Each chamber 150, 160 also may have a gas outlet 240 and a water outlet 250. The gas outlet 240 may be positioned adjacent to the driving face 200 of the piston head 170, 180 while the water outlet 250 may be adjacent to the pumping face 210 of the piston head 170, 180.

The water source 110 may be in communication with the water pump 140 via an incoming water line 260. The water line 260 may be made out of copper, stainless steel, rubber tubing, plastic, or similar materials. The incoming water line 260 may be connected to the water inlet 230 of both of the chambers 150, 160. The gas source 120 may be connected to the water pump 140 via an incoming gas line 270. The incoming gas line 270 may be made out of copper, stainless steel, plastic, or similar types of materials. The incoming gas line 270 may be connected to the gas inlet 220 of both of the chambers 150, 160. The incoming gas line 270 may have a supply valve 280 positioned thereon between the gas inlets 220 of the chambers 150, 160. The supply valve 280 may alternate the supply of gas to the chambers 150, 160 so as to create the reciprocating action of the piston heads 170, 180.

Specifically, the supply valve 280 alternates the delivery of carbon dioxide gas into the chambers 150, 160. As the pressurized gas travels towards, for example, the driving face 200 of the first chamber 150, the first piston head 170 is urged to the right (away from the gas inlet 220) such that any water within or adjacent to the pumping face 210 is forced out of the water outlet 250. This motion also forces the second piston head 180 all the way to the right (towards the gas inlet 220), thereby opening the first chamber 150 so as to allow water to enter through the water inlet 230. The process is then reversed as the supply valve 280 diverts a supply of the carbon dioxide gas into the second chamber 160. The pressurized gas forces the second piston head 180 to the left (away from the gas inlet 220) so as to force any water within the first chamber 150 out through the water outlet 250. Likewise, the first piston head 170 also is urged to the left (towards the gas inlet 220) and forces the carbon dioxide gas therein out through the gas outlet 240. This process is then continuously repeated as desired so as to provide fluid flow therethrough.

The water pump 140 also may have an outgoing water line 290 connected to both of the water outlets 250 of the chambers 150, 160 and an outgoing gas line 300 connected to both of the gas outlets 240 of the chambers 150, 160. The outgoing water line 290 and the outgoing gas line 300 may merge at a T-joint 310 or at a similar type of structure into a single outgoing line 320. The plain water and the gas thus begin to mix in the outgoing line 320 to form a flow of carbonated water. An external check valve 330 may be placed on the outgoing gas line 300 so as to prevent a backup of water therethrough.

The beverage dispenser 100 also may include a booster pump 340. The booster pump 340 may be any conventional type of gas-driven pump. The booster pump 340 may be identical to the water pump 140 described above with the exception that the gas outlets 240 of the respective chambers 150, 160 may be vented to the atmosphere. The booster pump 340 may be connected to the water pump 140 via the outgoing line 320. The booster pump 340 may boost the pressure of the water by a predetermined amount. For example, if the water in the outgoing line 320 is at about thirty (30) psig (about 2 kg/sq cm), the booster pump 340 may boost the pressure up to about one hundred (100) psig (about 7 kg/sq cm).

The beverage dispenser 100 also may include a cold plate 350. The cold plate 350 may be of conventional design. As is well known, the cold plate 350 may have one or more channels or passageways therein where the liquid flowing therethrough may be chilled through contact with the walls of the cold plate 350. The cold plate 350 may be made out of aluminum or other materials with good heat transfer characteristics. The cold plate 350 generally may be positioned adjacent to an ice bin or another source of heat transfer. The cold plate 350 may be about 150 to about 200 square inches (about 10 to about 13 square centimeters) in size. Alternatively, the cold plate 350 may be sized according to the throughput of the dispenser 100 as a whole. Any convenient size may be used. In this example, the cold plate 350 may lower the temperature of the water therein to less than about forty degrees Fahrenheit (40° F.) (about 44° C.). The cold plate 350 may be connected to the booster pump 340 via a cold plate line 360. Alternatively, the input water from the water source 110 may run through the cold plate 350 so as to pre-chill the water before the water enters the water pump 140.

The beverage dispenser 100 also may have a post mix valve 370. The post mix valve 370 may be of conventional design. The post mix valve 370 may be manually operated or driven by any convenient means. The post mix valve 370 mixes the water coming from the cold plate 350 via a cold water line 380 with one of more sources of syrup or concentrate 390, or other type of fluid. The syrup or concentrate may be pumped from the syrup source 390 to the post mix valve 370 via a syrup pump 395. The syrup pump 395 may be identical to the pumps 140, 340 described above. The syrup also may travel through the cold plate 350.

In use, the beverage dispenser 100 may provide a carbonated beverage. The water pump 140 pumps a supply of water from the plain water source 110. The pump 140 may be driven by gas from the gas source 120. For example, carbon dioxide gas at about sixty (60) psig (about 4 kg/sq cm) may be supplied to the gas inlet 220 of the chambers 150, 160 while water from the water source 110 may be provided to the water inlet 230 of the chambers 150, 160 at about zero (0) psig (about 0 kg/sq cm) and at room temperature or about seventy-five (75) degrees Fahrenheit (75° F.) (about 24° C.).

The supply valve 280 alternates the supply of gas to the first chamber 150 and the second chamber 160. This alternating supply provides a reciprocating motion for the piston heads 170, 180. As the pressurized gas travels through the water pump 140, the gas loses pressure due to the expanding area within the chambers 150, 160. The pressurized gas that leaves the water pump 140 therefore may have dropped to about thirty (30) psig (about 2 kg/sq cm), while the water therein has increased in pressure from about zero (0) psig (about 0 kg/sq cm), also to about thirty (30) psig (about 2 kg/sq cm). The water and the pressurized gas then begin to mix at the T-joint 310 to form the flow of carbonated water.

The pressure on the flow of carbonated water is then increased in the booster pump 340. This increase in pressure prevents or limits the carbon dioxide gas from breaking out of the water solution. The flow of the carbonated water is then chilled in the cold plate 350 from room temperature, about seventy-five degrees Fahrenheit (75° F.) (about 24° C.), to about thirty-five degrees Fahrenheit (35° F.) (about 2° C.). The drop in temperature also assists in dissolving the carbon dioxide gas within the water and preventing carbon dioxide break out.

The amount of carbon dioxide gas dissolved within the water can be adjusted by adjusting the inlet gas pressure at the regulator 130. The use of an input gas pressure of about sixty (60) psig (about 4 kg/sq cm) may provide a target carbonation level of about five (5) volumes. The water pump 140 thus acts to meter the proper amount of carbon dioxide gas within the water. The booster pump 340 likewise provides sufficient water flowing pressure so as to minimize carbonation breakout.

The present invention thus provides a beverage dispenser 100 that creates a carbonation beverage without the use of a carbonator tank or without the use of electricity to operate the carbonator tank. The beverage dispenser 100 of the present invention thus may be compact and portable. The present invention thus may provide a beverage dispenser 100 that may be situated in, for example, an airline beverage cart.

Figure 2:
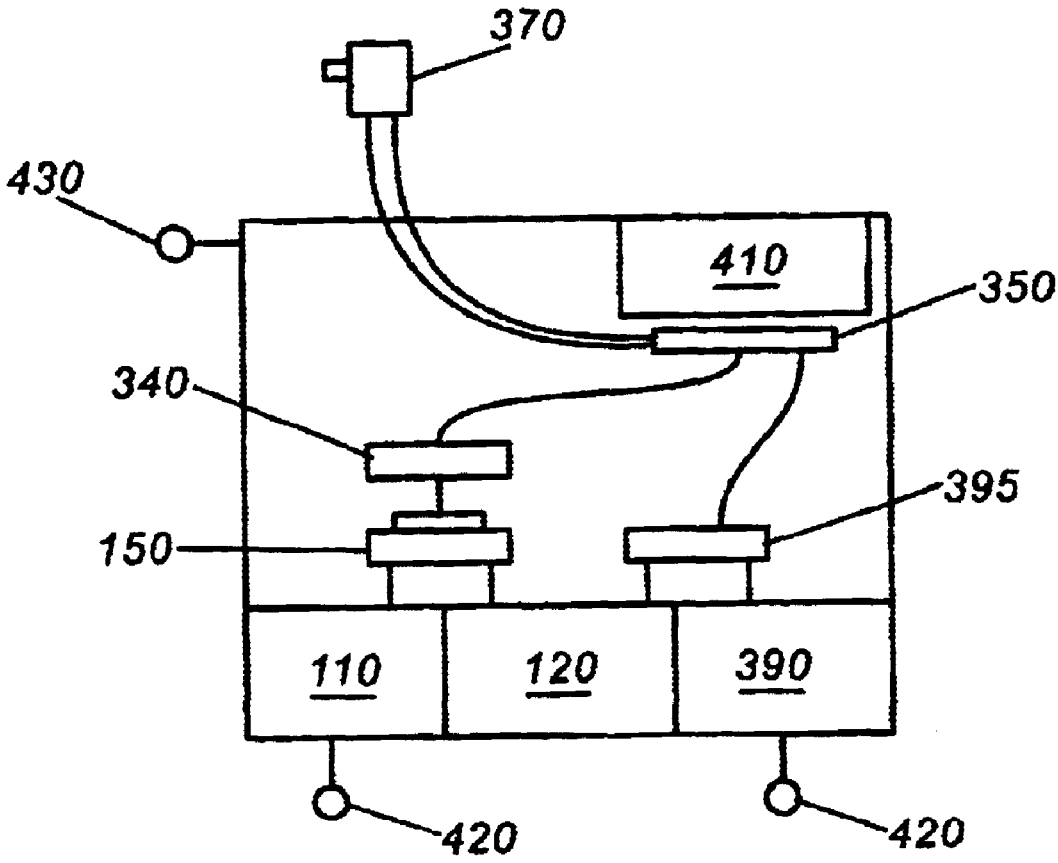
FIG. 2 is a schematic view of a portable beverage dispenser of the present invention.

For example, FIG. 2 shows a beverage cart 400 of the present invention. The beverage cart 400 may be of conventional design and may have an ice chest 410 positioned therein or another source of heat transfer. The cold plate 350 may be positioned adjacent to the ice chest 410. As is shown, the beverage cart 400 may include the water source 110, the gas source 120, and the syrup source 390. More than one type of syrup source 390 may be provided herein.

The water and the gas are pumped through the water pump 140, mixed together, and pumped through the booster pump 340. The carbonated water then flows through the cold plate 350 and into the post mix valve 370 as described above. Likewise, the syrup from the syrup source 390 also may run through the cold plate 350 and into the post mix valve 370. The syrup and the carbonated water are then mixed to form the carbonated beverage and served to a consumer.

Although the beverage cart 400 may take any desired form, the beverage cart 400 may have wheels 420 and a push handle 430 or similar types of elements. The beverage cart 400 thus may be substantially mobile and easy to maneuver. Alternatively, the beverage dispenser 100 also could be fixedly or replaceable mounted as desired. In either situation, the present invention provides a beverage dispenser 100 that avoids the need for a source of electrical power.

It should be understood that the foregoing relates only to certain disclosed embodiments of the present invention and that numerous modifications or alterations may be made herein without departing from the spirit and scope of the invention as set forth in the appended claims and equivalents thereof.

What is claimed is:

1. A beverage dispenser for providing a flow of carbonated water from a pressurized source of gas and a source of water, comprising:

a pump;

said pump driven by the gas from said gas source to pump the water from said water source;

said pump comprising a water outlet;

said pump comprising a gas outlet; and a connector in communication with said water outlet and said gas outlet so as to combine the gas and the water.

2. The beverage dispenser of claim 1, wherein said pump comprises a reciprocating pump.

3. The beverage dispenser of claim 1, wherein said pump comprises a first chamber and a second chamber.

4. The beverage dispenser of claim 3, further comprising a gas regulator positioned between the gas source and the pump so as to direct the gas from said gas source to said first chamber and said second chamber.

5. The beverage dispenser of claim 4, wherein said pump comprises a first piston head positioned within said first chamber and a second piston head positioned within said second chamber.

6. The beverage dispenser of claim 5, wherein said pump comprises a linkage connecting said first piston head and said second head.

7. The beverage dispenser of claim 5, wherein said first piston head and said second piston head each comprise a driving face and a pumping face.

8. The beverage dispenser of claim 7, wherein said pump comprises a water inlet and a gas inlet.

9. The beverage dispenser of claim 8, wherein said gas inlet comprises a first chamber gas inlet positioned adjacent to said driving face of said first piston head and a second chamber gas inlet positioned adjacent to said driving face of said second piston head.

10. The beverage dispenser of claim 9, wherein said water inlet comprises a first chamber water inlet positioned adjacent to said pumping face of said first piston head and a second chamber water inlet positioned adjacent to said pumping face of said second piston head.

11. The beverage dispenser of claim 10, wherein said gas outlet comprises a first chamber gas outlet positioned adjacent to said driving face of said first piston head and a second chamber gas outlet positioned adjacent to said driving face of said second piston head.

12. The beverage dispenser of claim 11, wherein said water outlet comprises a first chamber water outlet positioned adjacent to said pumping face of said first piston head and a second chamber water outlet positioned adjacent to said pumping face of said second piston head.

13. The beverage dispenser of claim 12, wherein said supply valve directs the gas from said gas supply to said first chamber gas inlet so as to force said first piston head away from said first chamber gas inlet and so as to force said second piston head towards said second gas inlet and open said second chamber water inlet.

14. The beverage dispenser of claim 13, wherein said supply valve directs the gas from said gas supply to said second chamber gas inlet so as to force said second piston head away from said second chamber gas inlet and to force the water within said second chamber out of said second chamber water outlet and so as to force said first piston head towards said first chamber gas inlet, force the gas within said first chamber out of said first chamber gas outlet, and open said first chamber water inlet.

15. The beverage dispenser of claim 14, wherein said supply valve directs the gas from said gas supply to said first chamber gas inlet so as to force said first piston head away from said first chamber gas inlet and to force the water within said first chamber out of said first chamber water outlet and so as to force said second piston head towards said second chamber gas inlet, force the gas within said second chamber out of said second chamber gas outlet, and open said second chamber water inlet.

16. The beverage dispenser of claim 1, wherein said connector comprises a T-joint.

17. The beverage dispenser of claim 16, further comprising a booster pump positioned downstream of said connector so as to boost the pressure of the carbonated water flow.

18. The beverage dispenser of claim 17, further comprising a cold plate positioned downstream of said booster pump so as to chill the carbonated water flow.

19. The beverage dispenser of claim 18, further comprising a mixing valve positioned downstream of said cold plate so as to mix said carbonated water flow with a secondary fluid.

20. A portable beverage dispenser to serve a beverage from a source of a primary fluid, a source of a secondary fluid, and a source of a gas, said dispenser comprising:

a cart;

a primary fluid pump positioned on said cart and driven by the gas from said gas source to pump the primary fluid from said primary fluid source;

a secondary fluid pump positioned on said cart and driven by the gas from said gas source to pump the secondary fluid from said secondary fluid source; and a mixing valve positioned on said cart to mix the primary fluid and the secondary fluid.

21. The portable gas dispenser of claim 20, wherein said primary fluid pump comprises a gas outlet and a primary fluid outlet.

22. The portable gas dispenser of claim 21, further comprising a connector positioned on said cart, said connector in communication with said gas outlet and said primary fluid outlet so as to combine the gas and the primary fluid.

23. A device for combining a gas and a liquid, comprising:

a source of the gas;

a source of the liquid;

a pump;

said pump driven by the gas from said gas source to pump the liquid from said liquid source;

said pump comprising a liquid outlet;

said pump comprising a gas outlet; and a connector in communication with said liquid outlet and said gas outlet so as to combine the gas and the liquid.

* * * * *